United States Patent [19]

Eftefield

[11] 4,009,530

[45] Mar. 1, 1977

[54] APRON LIFT LINKAGE

[75] Inventor: Larry G. Eftefield, Joliet, Ill.

[73] Assignee: Caterpillar Tractor Co., Peoria, Ill.

[22] Filed: Apr. 9, 1976

[21] Appl. No.: 675,361

[52] U.S. Cl. ..... 37/126 AD; 37/129

[51] Int. Cl.[2] ..... E02F 3/75

[58] Field of Search ..... 37/124 R, 126 R, 126 AD, 37/129

[56] References Cited

UNITED STATES PATENTS

| | | | |
|---|---|---|---|
| 2,573,720 | 11/1951 | Lichtenberg | 37/126 AD |
| 3,739,506 | 6/1973 | Klett et al. | 37/126 AD X |

*Primary Examiner*—E. H. Eickholt
*Attorney, Agent, or Firm*—Phillips, Moore, Weissenberger Lempio & Majestic

[57] ABSTRACT

An earthmoving scraper having a tractor-drawn bowl with a pivotal apron thereon, and a lift linkage assembly comprising a pair of articulately connected links, one link being articulately connected to the sidewall of the bowl and the other link being articulately connected to the center of the front side of the apron, and a hydraulic jack connected between the articulately connected links and the bowl sidewall.

6 Claims, 6 Drawing Figures

Fig-6-
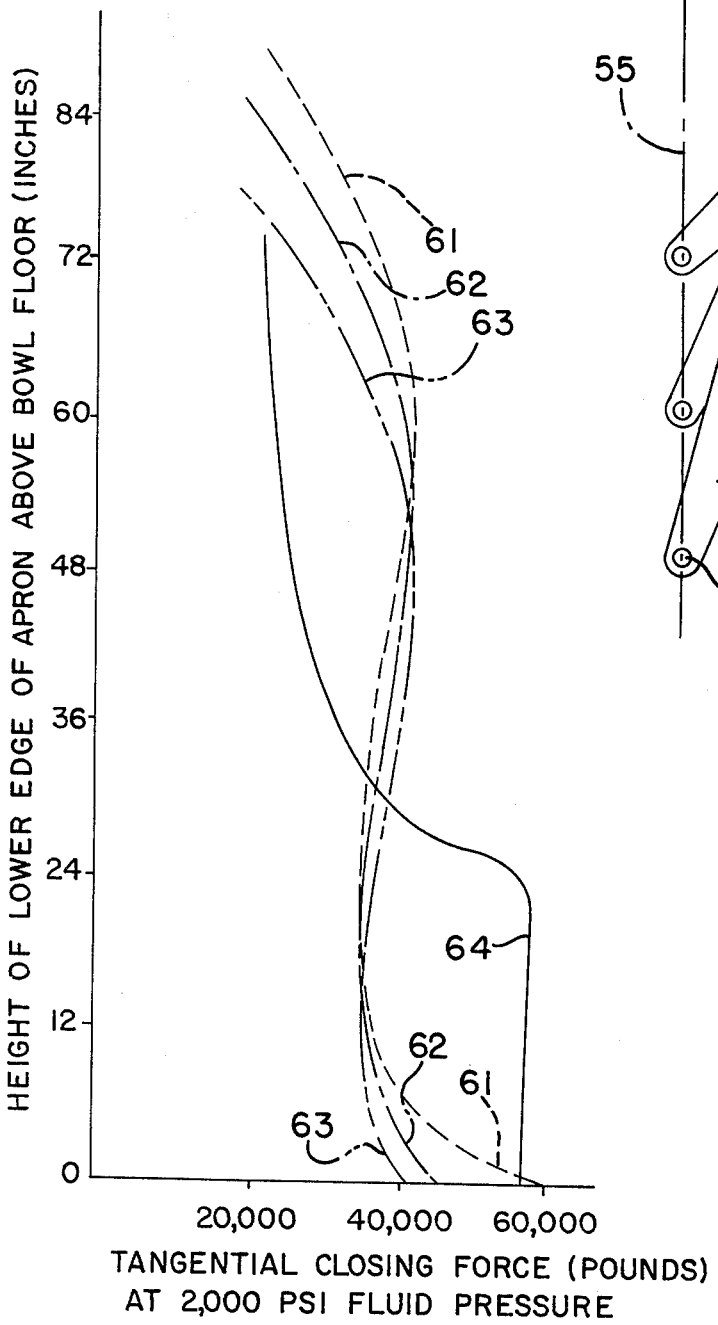
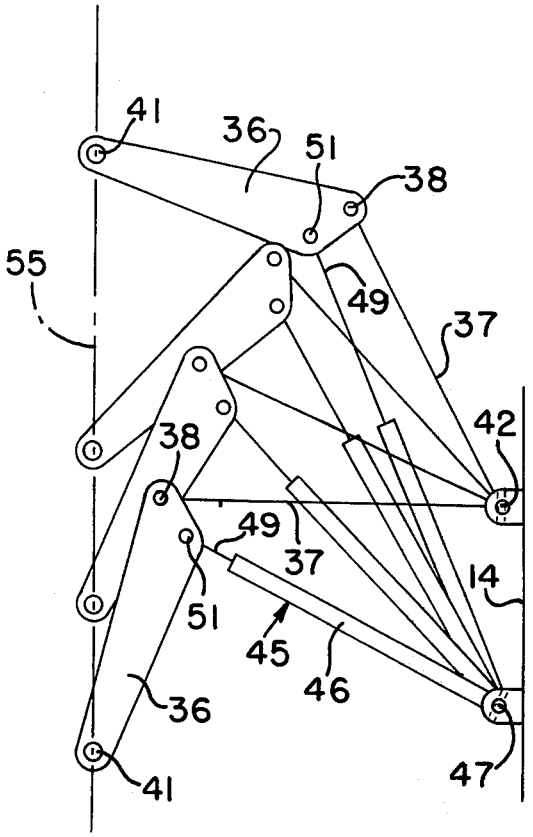
Fig-5-

APRON LIFT LINKAGE

BACKGROUND OF THE INVENTION

This invention relates to tractor-drawn scrapers having a pivotal apron mounted on the scraper bowl and more particularly to a lift linkage assembly for opening and closing the apron.

U.S. Pat. Nos. 3,553,860 and 3,854,381 illustrate the type of tractor-drawn scrapers to which the present invention is directed and show the presently conventional form of lift linkage assembly used for raising and lowering the apron. In particular, such lift linkage assembly has one end of the linkage mounted on the rear of the tractor unit, and the other end connected to the apron on the bowl unit and a hydraulic jack connected between the linkage and tractor unit for actuating the linkage to cause the apron to move between open and closed positions.

Such tractor-down scrapers also include lift jacks connecting between the rear of the tractor unit and the forward end of the bowl so that the forward end of the bowl can be raised or lowered relative to the tractor unit and to the ground in order to vary the elevation above ground of the cutting edge on the scraper bowl.

The degree of tangential closing force applied to the apron is of importance since in closing the apron from open position the lower edge to the apron must oftentimes be forced through the material being loaded into the scraper. Considerable force must be exerted at times to shear through material that is obstructing closing movement of the apron and blocking it open.

It has been found that with present conventional apron life linkage assemblies the apron closing force will vary in accordance with the elevation of the front end of the scraper bowl above ground. Also, the connection of the linkage assembly between the rear end of the tractor unit and the bowl apron closing force is needed to shear through an obstruction to closure.

Additionally, it is common practice to raise the front end of the bowl while simultaneously moving the apron downwardly to closed position, requiring use of sequence valves, of the type shown in the aforesaid U.S. Pat. No. 3,854,381, to coordinate the operation of the bowl lift and apron lift hydraulic jacks.

It is the primary object of the present invention to provide an apron lift linkage assembly which is a greater degree of tangential closing force over a considerable degree of movement to closed position, in which the closing force does not vary with changes in elevation of the bowl, which eliminates the need for a sequence valve, and which does not exert a strain on the tractor unit when a high shearing force is applied to the apron.

SUMMARY OF THE INVENTION

The primary object of the invention is met by providing an apron lift linkage assembly which is mounted completely on the bowl unit, the lift linkage assembly comprising a pair of articulately connected links, one of which is articulately connected to the sidewall of the bowl, while the other is articulately connected to the center of the front of the apron. A hydraulic jack is connected between the connected-together links and the bowl sidewall to actuate the lift linkage assembly to raise and lower the apron in such manner that little sidewards force is imposed on the apron.

By virtue of the present invention, a high degree of tangential closing force is provided for the apron over a considerable degree of closing movement thereof. Since no part of the linkage is connected to the tractor unit, no additional strain will be impaired on the rear of the tractor unit when the apron must shear through an obstruction.

The operation of the apron lift linkage assembly is independent of the height of the bowl and thus no sequencing valves are needed to correlate operation of the apron lift linkage assembly and of the bowl apparatus.

Other objects and advantages of the present invention will be set forth in the course of the following detailed description.

BRIEF DESCRIPTION OF THE DRAWINGS

In the drawings forming a part of this application and in which like parts are designated by like reference numerals throughout the same:

FIG. 5 is a generally-schematic view of the apron lift linkage assembly at various positions of the apron; and FIG. 6 is a graph comparing the tangential closing force on the apron by means of the present invention with that produced by prior art apron lifting mechanisms.

DESCRIPTION OF THE PREFERRED EMBODIMENT

Figure 1:
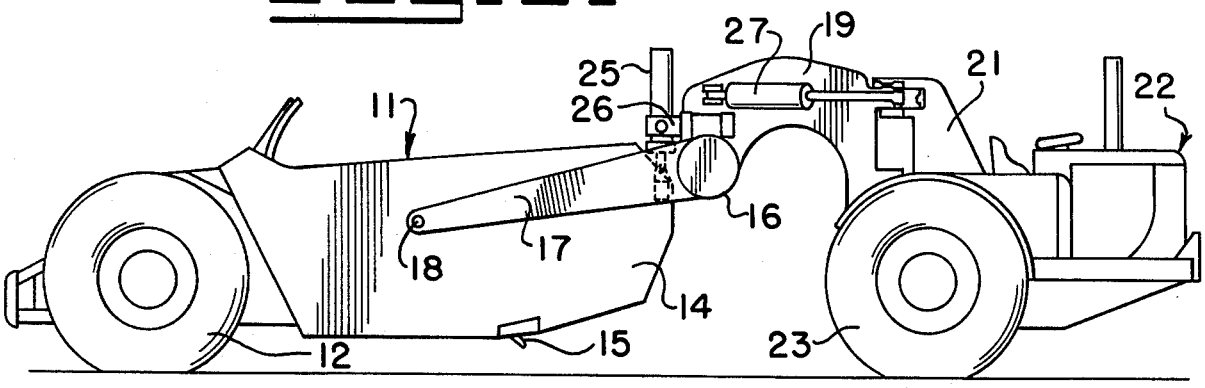
FIG. 1 is a side-elevational view of the tractor-drawn scraper embodying the present invention.
Figure 2:
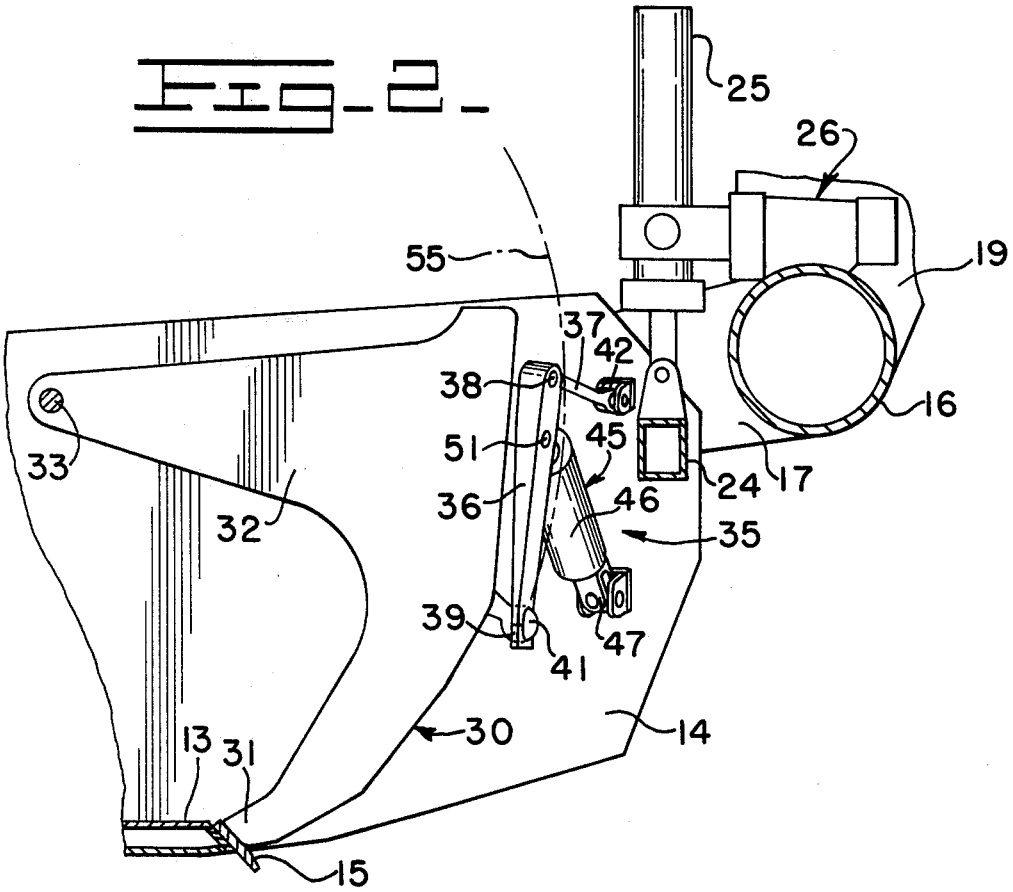
FIG. 2 is an elevational view, partly in section, of the front end of the scraper bowl.

Referring now to the drawings, wherein is illustrated a preferred embodiment of the invention, a tractor-drawn scraper is illustrated as having a bowl 11 rearwardly supported by a pair of wheels, one of which is shown at 12, the bowl having a floor 13 and sidewalls 14 and being open at its forward end. A cutting edge 15 is disposed along the forward edge of the bowl floor. To support the front end of the bowl, a transverse spreader tube 16 has a pair of draft arms 17 which extend rearwardly for pivotal connection, at 18, to the sidewalls 14 of the bowl. The spreader tube 16 of the draft frame is centrally secured to gooseneck 19 which extends forwardly to be pivotally supported by hitch 21 on the tractor 22. Tractor 22 is forwardly supported by a pair of wheels, one of which is shown at 23.

The scraper bowl also has a transverse spreader member 24 secured between the forward ends of the bowl sidewalls. To support the forward end of the bowl during operation of the scraper, a hydraulic lift cylinder or jack 25 is disposed generally at each side of the scraper and pivotally connected to an end of the spreader member 24 and by a gimbal mounting 26 to the transverse spreader tube 16 adjacent one of its arms 17. Operation of the lift jacks 25 will raise and lower the forward end of the bowl. Steering of the tractor-drawn scraper is conventionally accomplished by means of steering jacks, one of which is shown at 27.

The scraper bowl is provided with a conventional apron 30 extending across the open forward end of the bowl and having a lower edge 31 adapted to engage the cutting edge 15 of the bowl and thereby close off the bottom of the bowl. Apron 30 has rearwardly extending arms 32 at each side thereof which are pivotally mounted, as at 33, to the bowl sidewalls so that the apron may be pivoted about an axis transverse to the scraper bowl between a lowered open position and an upward closed position.

The apron 30 is raised and lowered by operation of the apron lift linkage assembly 35 which comprises a pair of links 36 and 37 having one end of each articulately connected together by pin 38. The other end of link 36 is articulately connected by a universal-type joint 39 to ball 41 on the forward, or outside, surface of the apron 30 centrally thereof. The other end of link 37 is articulately connected by universal joint 42 to the inside of the bowl sidewall. Universal joint 42 is located on the sidewall close to spreader member 24 to take advantage of the support provided the sidewall by that member.

A hydraulic jack 45 has the head end of its cylinder 46 articulately connected by universal joint 47 to the bowl sidewall, joint 47 being secured on the inside of the bowl sidewall below joint 42. The external end of axially movable jack rod 49 is articulately connected by pin 51 to link 36 near pin 38.

The head and rod ends of cylinder 46 are connected by hoses 52 and 53 and by a suitable manually controlled valve (not shown) to the high pressure hydraulic system of the scraper.

Figure 3:
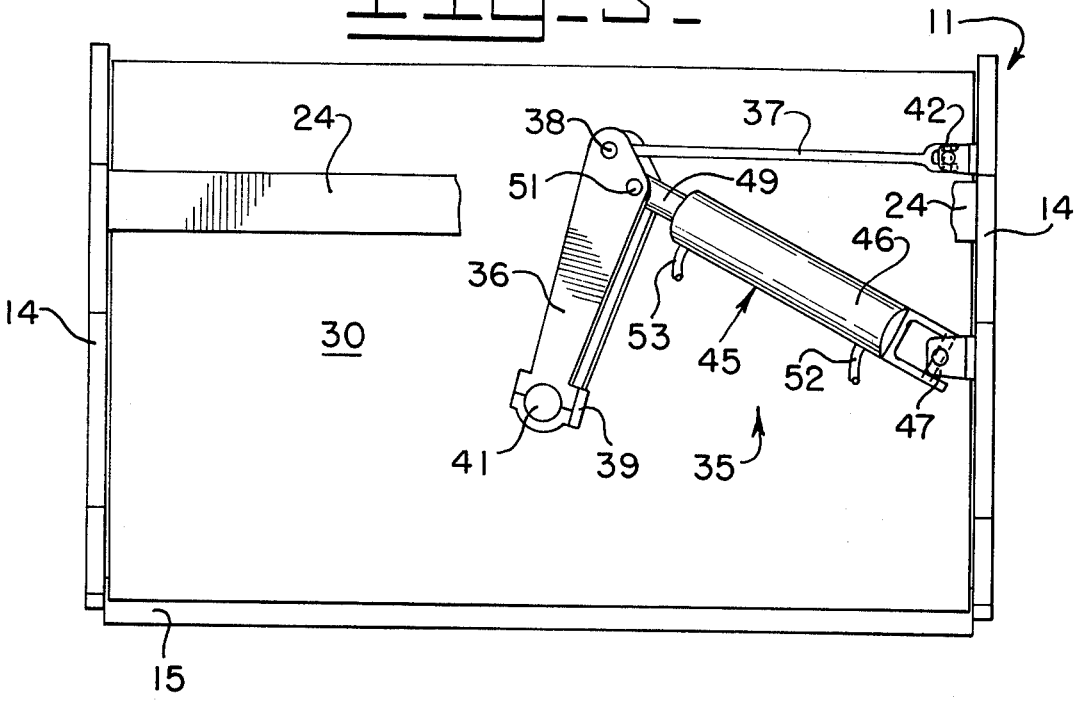
FIGS. 3 and 4 are front-elevational views of the scraper bowl showing the apron in closed and opened positions, respectively.
Figure 4:
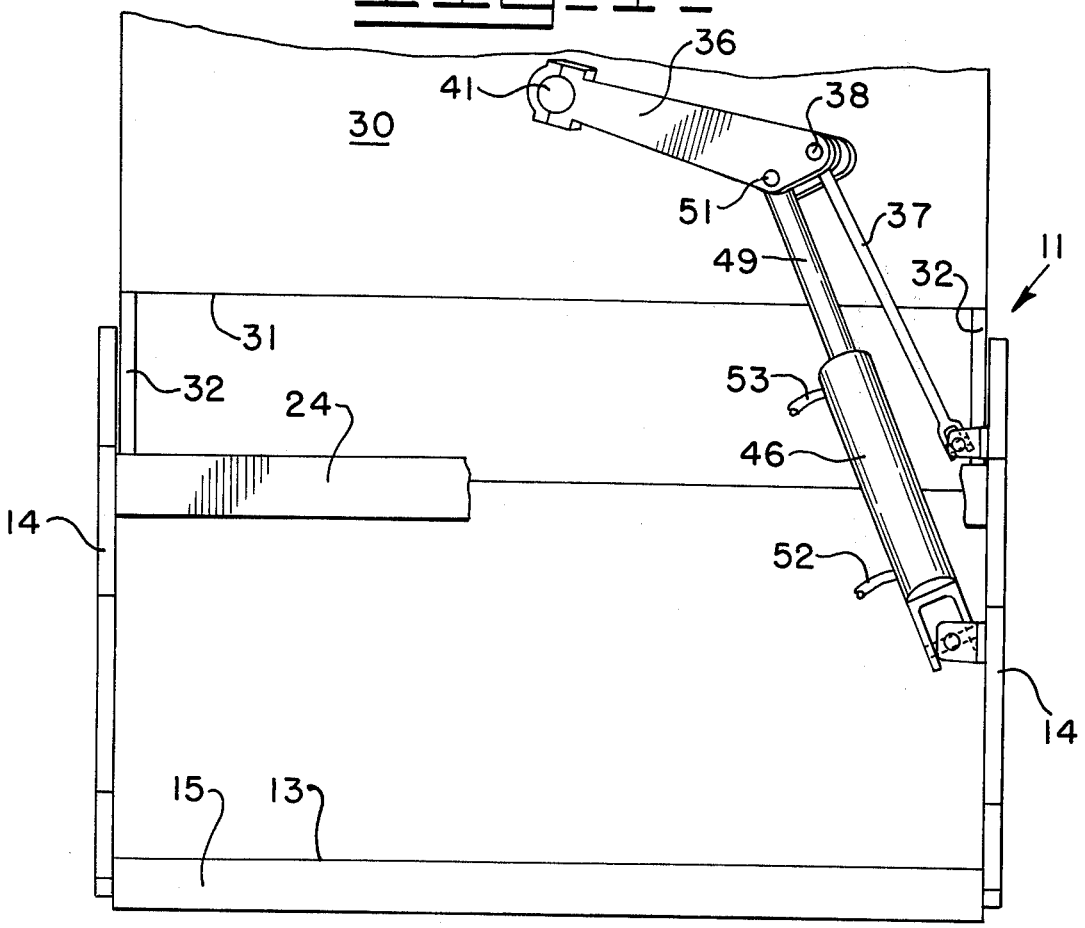

FIG. 5 illustrates the lift linkage assembly in the apron-closed position of FIG. 3, and the apron-open position of FIG. 4, as well as in two intermediate positions of the apron. As the apron is opened and closed, ball 41 on the front of the apron will travel along a vertical arcuate path having a radius of curvature determined by the distance from the axis of pivot points 33 to ball 41.

To raise apron 30 from its closed position, fluid under pressure is introduced through hose 52 to the head end of cylinder 46 to force rod 49 outwardly therefrom. Such extension of jack 45 causes link 37 to pivot upwardly around pin 42 to move pivot pin 38 upwardly through an arcuate path whose radius is the length of link 37. Such movement in turn acts through link 36 to produce a force on ball 41 having an upward tangential component along line 55 and a horizontal transverse component to the right, as seen in FIG. 5. As the inclination of link 36 from vertical increases, the upward component decreases while the horizontal component increases. At the same time, the hydraulic jack 45 acts on link 36 through pivot pin 51. Such force, axially of jack 45, intersects the line between pin 38 and ball 41 at a point close to but spaced from pin 38. As a result, a moment force is produced in link 36 forcing it to rotate in a clockwise direction about pin 38 so that link 36 exerts on apron ball 41 an upward tangential force and a relatively small horizontal force to the left. This latter horizontal force to the left is opposed by the apron and bowl side that functionally restrains the apron in the bowl. Because pin 51 is offset from the line between pin 38 and ball 41, the moment arm becomes greater as the inclination of link 36 from vertical increases. Accordingly, as the inclination of the link increases, the upward tangential component on ball 41, due to the forced rotation of link 36, will increase, thus offsetting the decrease in upward tangential force on ball 41 as the upward movement of the pivot pin 38 causes an increasing inclination of the link 36 from vertical.

FIG. 6 illustrates the effectiveness of the lift linkage arrangement of the present invention as compared to the conventional apron closing linkage illustrated in the aforesaid U.S. Pat. No. 2,553,860 and No. 3,854,381. Each of the illustrated curves show the tangential closing force on the apron, produced by operation of the hydraulic jack, plotted against the degree of opening of the apron (the height of the lower edge of the apron above the bowl floor). Curves 61, 62 and 63 show the tangential closing force for conventional systems at different elevations of the cutting edge of the bowl above the ground. Curve 61 shows the tangential force produced by the conventional system when the cutting edge is approximately five inches above the ground. Curves 62 and 63 show the tangential force for the same system but when the cutting edge is 13 and 21 inches above the ground, respectively. In each case, the hydraulic jack was connected to a 2,000 psi force of pressure fluid. As will be noted, the closing force at fully-closed position varies considerably with elevation of the cutting edge, due to the conventional arrangement wherein part of the apron lift linkage is carried by the rear end of the tractor while the remaining part of the linkage is secured to the apron. Also, it will be noted that the closing force is generally below 40,000 pounds until the apron is almost closed on a lowered bowl.

Curve 64 illustrates the tangential closing force produced by the lift linkage of the present invention, utilizing the same amount of hydraulic fluid pressure. Since the lift linkage is carried completely by the bowl and apron, the closing force is independent of the height of the cutting edge above the ground. As will be noted, the closing force is essentially constant, and just slightly less than 60,000 pounds from an open position of 24 inches until fully closed, a force considerably greater than those of the conventional systems. Above 24 inches, the closing force decreases and becomes less than that of the conventional systems, but this is not disadvantageous since considerably less force is required to close the apron when open to such an extent.

What is claimed is:

1. In a tractor-drawn scraper having a bowl rearwardly supported by wheels, said bowl including a floor and sidewalls, and being open at its forward end, a cutting edge disposed along the forward edge of the bowl floor, an apron at the forward open end of said bowl, said apron being pivotally mounted on the bowl sidewalls for pivotal movement about an axis transverse to said bowl and rearwardly of said apron and between a lower closed position and an upper open position wherein the lower edge of said apron is substantially above said cutting edge, a tractor forwardly supported by wheels and having draft arms extending rearwardly thereof to pivotal connections on the bowl sidewalls, hydraulic lift jack means connected between the rear of said tractor and the front of said bowl for raising and lowering the front of said bowl, the improvement comprising:

first and second links, one end of said first link being articulately connected with one end of said second link;

means articulately connecting the other end of said first link to the center of said apron;

means articulately connecting the other end of said second link to one of said sidewalls of said bowl forwardly of said apron;

a hydraulic jack having a cylinder and an axially movable rod extending from said cylinder;

means for articulately connecting one end of said hydraulic jack to one of said links near said one end thereof; and means articulately connecting the other end of said hydraulic jack to said one sidewall of said bowl at a position vertically spaced from the other end of said second link.

2. In a tractor-drawn scraper as set forth in claim 1, wherein said one end of said hydraulic jack is connected to said first link.

3. In a tractor-drawn scraper as set forth in claim 1, wherein said other end of said hydraulic jack is connected to said sidewall below the connection of said other end of said second link to said sidewall.

4. In a tractor-drawn scraper as set forth in claim 1, wherein said one end of said hydraulic jack is connected to said first link and said other end of said hydraulic jack is connected to said sidewall below the connection of said other end of said second link to said sidewall.

5. In a tractor-drawn scraper as set forth in claim 4, wherein the connection of said hydraulic jack to said first link is offset from a line between the connections of said first link with said apron and said second link.

6. In a tractor-drawn scraper as set forth in claim 4, wherein said scraper bowl includes a transverse spreader member extending between the sidewalls of said bowl near the front end of said bowl, and wherein said second link is connected to said sidewall in close proximity to said transverse spreader member.

* * * * *